US006210809B1

(12) United States Patent
Okutomi et al.

(10) Patent No.: US 6,210,809 B1
(45) Date of Patent: Apr. 3, 2001

(54) CONTACT MATERIAL

(75) Inventors: Tsutomu Okutomi, Kanagawa-ken; Atsushi Yamamoto, Tokyo; Iwao Ohshima, Kanagawa-ken; Tsuneyo Seki, Tokyo; Mitsutaka Homma, Saitama-ken; Takashi Kusano, Tokyo, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/223,813

(22) Filed: Dec. 31, 1998

(30) Foreign Application Priority Data

Jan. 6, 1998 (JP) ..... 10-000742

(51) Int. Cl.[7] ..... C22C 29/00; H01H 1/02

(52) U.S. Cl. ..... 428/546; 200/264; 200/266; 428/567; 428/568; 428/610; 428/674; 428/687; 428/926; 428/929

(58) Field of Search ..... 428/546, 567, 428/568, 929, 610, 674, 687, 926; 75/237, 239, 241, 243, 247; 200/264, 266; 420/488, 492, 495, 496, 499, 500

(56) References Cited

U.S. PATENT DOCUMENTS

| | | | | |
|---|---|---|---|---|
| 5,045,281 | * | 9/1991 | Okutomi et al. | 420/495 |
| 5,149,362 | * | 9/1992 | Okutomi et al. | 75/247 |
| 5,420,384 | * | 5/1995 | Okutomi et al. | 200/264 |
| 6,027,821 | * | 2/2000 | Yamamoto et al. | 428/929 |

FOREIGN PATENT DOCUMENTS 8-180774 7/1996 (JP) .

* cited by examiner

*Primary Examiner*—Deborah Jones
*Assistant Examiner*—Robert R. Koehler
(74) *Attorney, Agent, or Firm*—Oblon, Spivak, McClelland, Maier & Neustadt P.C.

(57) ABSTRACT

The contact material of the present invention comprises: an anti-arcing constituent consisting of at least one TiC, V and VC of which the content is 30~70 volume % and whose mean particle (grain) size is 0.1~9 μm; C whose content is 0.005~0.5 weight % with respect to the anti-arcing constituent, whose diameter is 0.01~5 μm when its shape is calculated as spherical, and which is in non-solid solution condition or condition in which it does not form a chemical compound; and a conductive constituent consisting of Cu and constituting the balance.

8 Claims, No Drawings

CONTACT MATERIAL

BACKGROUND OF THE INVENTION

1. Field of the Invention

The present invention relates to a contact material of excellent current chopping characteristic and high voltage withstanding characteristic.

2. Description of the Related Art

For example vacuum interrupter contacts are constructed of various raw materials in order to maintain and improve the three basic requirements represented by anti-welding interrupting characteristic, voltage withstanding characteristic, and current interrupter characteristic, and, in addition, current chopping characteristic, erosion characteristic, contact resistance characteristic, and temperature rising characteristic etc.

However, since, for the characteristics demanded above, mutually contradictory material properties are typically required, these cannot be fully satisfied by a single element. Accordingly, the present situation is that contact materials adapted to specific applications such as large current interrupter characteristic applications, high voltage withstanding characteristic applications, or low current chopping characteristic applications are being developed by such measures as use of composite materials or cladding separate members together, and these have excellent characteristics in their own way.

As contact materials for large current interruption for satisfying the basic three requirements for ordinary vacuum circuit breakers, there are known for example Cu—Bi alloy and Cu—Te alloy containing up to 5 weight % of anti-welding constituents such as Bi or Te (Issued Japanese Patent No. Sho.41-12131 and Issued Japanese Patent No. Sho.44-23751). In the case of Cu—Bi alloy, the brittle Bi, Cu—Te alloy that is precipitated at the grain boundaries produces embrittlement of the grain boundaries and the brittle Cu—Te that is precipitated within the particles produces embrittlement of the alloy itself; as a result, a low weld pull-apart force is realized, enabling an excellent large current interrupter characteristic to be achieved. Of these alloys, contacts in which the Bi content is for example around 10 weight % have suitable vapor pressure characteristics, so they exhibit excellent current chopping characteristics (Issued Japanese Patent No. Sho.35-14974). Cu—Cr alloy is known as a contact material for contacts likewise satisfying the three basic requirements, having high voltage withstanding characteristics and a large current interrupter characteristic. This alloy has the advantage that it can be expected to show more uniform performance than the Cu—Bi alloy or Cu—Te alloy mentioned above since the vapor pressure difference between its constituents is small and, depending on the way in which it is used, shows excellent performance.

On the other hand, in recent years, it has become necessary to further improve the current chopping characteristic and voltage withstanding characteristic (restriking characteristic) of vacuum interrupters intended to be of high-reliability, miniaturized type.

Firstly, vacuum interrupter contacts, in which current chopping (or current switching) is performed under high vacuum by utilizing the dispersion of an arc in vacuum, are constructed of a pair of fixed and movable contacts arranged facing each other. If, when used in an inductive circuit such as an electric motor load, current is interrupted without sufficient care regarding the vacuum interrupter, an excessive abnormal surge voltage is generated, which may affect the insulating characteristics of the load equipment. The reasons for occurrence of this abnormal surge voltage include the phenomenon of chopping occurring on the low-current side (i.e. current interruption is performed forcibly without waiting for the natural zero point of the AC current waveform) when performing small-current interruption in vacuum, or the phenomenon of high frequency arc extinction. The value Vs of the abnormal surge voltage is proportional to the surge impedance $Z_0$ of the circuit and the current chopping value Ic. As one means of suppressing the abnormal surge voltage value Vs to a low level, it is therefore necessary to make the current chopping value Ic low. In this connection, Ag—WC alloy can be utilized as one type of contact alloy that is advantageous in respect of this demand.

Ag—WC alloy (Ag 40%) is known as an example of such a low chopping characteristic contact material, and has an excellent low chopping characteristic on account of the synergetic action of the thermion discharge effect of WC and the appropriate vapor pressure of Ag (Japanese Patent Application No. Sho.42-68447). It is also suggested that benefits can be obtained in improving the current chopping characteristic by using contact material in which the particle size of the anti-arcing constituent material (for example the particle size of WC) is 0.2~1 $\mu$m (Issued Japanese Patent No. H.5-61338). In addition, contact materials are also known (Early Japanese Patent Publication No. H.4-206121) in which a large current interrupter characteristic is improved by obtaining good mobility of the arc cathode point by the use of a contact material in which the inter-particle separation of WC—Co particles is chosen to be 0.3~3 $\mu$m.

Secondly, the phenomenon of the occurrence of a conductive condition (subsequent discharge does not continue) between the electrodes may be produced in a vacuum interrupter by occurrence of flashover within the vacuum interrupter after current interruption. This phenomenon is called restriking. Although the mechanism of its occurrence is not understood, it can easily generate abnormal overvoltage, since there is an abrupt change to a conductive condition after the electrical circuit has first been put into a current interrupting condition. Even in the case of an interrupter using Ag—WC alloy, whose current interrupting characteristics are excellent, according to tests in which restriking was produced by interrupting a capacitor bank, occurrence of very large overvoltage and/or occurrence of excessive high frequency currents were observed. Development of a technique for suppressing occurrence of restriking for contacts using Ag—WC alloy is therefore sought. The mechanism of occurrence of the restriking phenomenon of Ag—WC alloy is as yet unknown but according to the experimental observations of the present inventors restriking occurs with fairly high frequency between one contact and another contact in vacuum interrupters and between the contacts and the arc shield. The present inventors were therefore able to achieve a contribution to suppression of occurrence of restriking by showing that techniques for suppression of abrupt gas that is released for example when the contacts are subjected to arcing and techniques for optimization of the form of the contact surface are very effective in suppressing occurrence of restriking. Specifically, by noting the total amount of gas released in the process of heating the Ag—WC alloy, the type of gas and its mode of ignition, and observing the inter-relationship with occurrence of restriking, they discovered that contacts in which a large amount of gas is abruptly released in the form of a pulse, even though only for a very short time, in the vicinity of the melting point, show a high rate of occurrence of restriking. Accordingly, occurrence of restriking was reduced by removing beforehand one of the causes of release of abrupt gas in the Ag—WC alloy by for example heating to above the melting point of Ag, or by improving sintering technology such as to suppress pores or structural segregation in the Ag—WC alloy. However, the need for further improvement is recognized and it has become important to develop other measures to meet recent demands for further suppression of restriking. In recent years, the diversity of loads has increased and conditions of use demanded by users have shown a marked tendency to become more severe, including for example application to reactor circuits and capacitor circuits and demands have increased for a low current chopping Ag—WC alloy with even lower chopping characteristics and even lower restriking characteristics, and the development and improvement of contact materials in this respect has become an urgent task. In capacitor circuits, the voltage which is applied is two or three times that which is normally employed, so there is severe damage to the contact surf aces by the arc on current interruption or current switching. This tends to cause surface roughness of the contacts and exfoliative erosion. Since contact erosion is believed to be a cause of restriking, it is also necessary to reduce erosion. However, even though the restriking phenomenon is important from the standpoint of improving product reliability, so far from techniques for preventing it, even its direct causes are still unknown. Ag—WC alloy is employed as a low current chopping characteristic contact material in preference to Cu—Bi alloy, Cu—Te alloy, or Cu—Cr alloy as mentioned above, but the present situation is that it does not provide a fully satisfactory contact material in respect of increasing demands for low current chopping characteristic and low restriking characteristic, and furthermore it is desired to have both these characteristics together to a higher degree. Specifically, even in the case of Ag—WC alloy, which is up to the present preferentially employed as a low current chopping contact material, occurrence of restriking is still observed in circuits having more severe high voltage regions and large rush current. Accordingly, development of a contact material is desired wherein, while maintaining the above-mentioned three basic requirements at a fixed level, in particular both a low chopping characteristics and a good restriking characteristic can be obtained.

SUMMARY OF THE INVENTION

Accordingly, one object of the present invention is to provide a novel contact material combining both a good current chopping characteristics and restriking characteristics.

In order to achieve this object, the essence of the present invention consists in the provision of an anti-arcing constituent consisting of at least one of TiC, V and VC in a content of 30~70 volume %, of mean particle (grain) size 0.1~9 $\mu$m, C in non-solid solution condition or condition not forming a (chemical) compound in a content of 0.005~0.5 weight % with respect to the anti-arcing constituent and of diameter 0.01~5 $\mu$m, calculated for a spherical shape, the balance being a conductive constituent constituted by Cu.

As described above, although Ag—WC alloy is employed as a low chopping characteristic contact material to provide contacts exhibiting stable characteristics, there is need for further improvement in regard to the demand to improve simultaneously both the current chopping characteristic and the restriking characteristic. In modern interrupters, it is very important to improve both characteristics concurrently and in particular to maintain low values thereof even after switching a prescribed number of times, and to achieve low values of the range of variability of these characteristics.

When a large current is interrupted by applying an external magnetic field (for example in the perpendicular magnetic field technique) to Cu—TiC—C contacts according to the present invention the arc that is generated by the interruption wanders over the contact electrode surface and is prevented from stagnating or concentrating in regions of low arc voltage. This thereby maintains a low current chopping characteristic and contributes to a reduction in the rate of occurrence of restriking. Specifically, since the arc can wander easily over the contact electrodes, diffusion of the arc is promoted, thereby essentially increasing the contact electrode area that is involved in the process of current interruption and reducing arc stagnation and concentration. As a result, the advantages are obtained of inhibition of local abnormal vaporization of the contact electrodes and of a reduction of surface roughness, thereby contributing to prevention of restriking.

However, if a current value above a certain value is interrupted, the arc stagnates at a point or points that cannot be predicted and abnormal melting occurs i.e. the interruption limit is reached. Also, in the case of abnormal melting, metallic vapor generated by explosive instantaneous evaporation of the Cu—TiC—C contact material severely hinders insulation recovery of the vacuum interrupter that was in the process of electrode parting, causing a further deterioration of the interruption limit. Furthermore, abnormal melting creates giant molten drops and causes roughness of the contact electrode surface, lowering the voltage withstanding characteristic, increasing the rate of occurrence of restriking, and causing abnormal erosion of the material. Thus, it is desirable that surface conditions should be applied to the contacts such that, as described above, it is completely impossible to predict where the arc that causes these phenomena will dwell on the surface of the contact electrodes or that the arc that is generated should be able to wander and disperse without stagnating.

To achieve this desirable condition, in the present invention, the TiC content and C content in the Cu—TiC—C alloy are optimized and the size of the C is optimized. As a result, improvement in the adhesive strength of the TiC particles and C particles that are effective in suppressing restriking, as well as structural uniformity of the Cu and TiC in the contact material are achieved. As a result, not only is the Cu that is evaporated and dispersed selectively and preferentially when subjected to arcing controlled such as to be diminished, but also formation of cracks, which are very deleterious in respect of occurrence of restriking, on the contact surface as a result of thermal shock on subjection to arcing is suppressed, and dispersion and exfoliation of TiC particles is decreased. In particular, the C content, which is in non-solid solution condition or in condition not forming a chemical compound is optimized as 0.005~0.5 (weight %) with respect to the TiC content, and its size is controlled to 0.01~5 $\mu$m or less (diameter when calculated as a sphere). Such a contact alloy structure reduces deterioration of the restriking characteristic to a minimum and, in addition, improves the current chopping characteristic and contributes to stability.

Although Cu—TiC—C was illustrated above as a typical example, the presence of C under prescribed conditions has similar benefits in Cu—TiC—Co alloy, Cu—TiC—Fe alloy and Cu—TiC—Ni alloy. It should be noted that according to the experiments of the inventors, by optimizing the content and size of C in Cu—TiC, improvements can be obtained such as more uniform distribution of Cu, TiC and C in the alloy structure, as well as mutual adhesive strength of the Cu, TiC and C, so, even after arcing, giant melting scars or dispersion damage etc., which are deleterious in regard to occurrence of restriking, become infrequent, and contact surface roughness, which has an important effect in preventing restriking, is also reduced; this is beneficial in improving resistance to arcing erosion. Improvement of resistance to arcing erosion improves the smoothness of the contact surfaces and is beneficial in reducing the range of variability of current chopping characteristic and restriking characteristic even after switching a large number of times. By means of these synergetic effects, the current chopping characteristic is improved and control of the frequency of occurrence of restriking of the Cu—TiC alloy and improvement of erosion resistance are obtained.

It is desirable that the C that is present in prescribed ratio in the Cu—TiC should be in a non-solid solution condition or a condition in which it does not form a chemical compound. If it is not in such condition (C in non-solid solution condition or condition in which it does not form a chemical compound), stability of the current chopping characteristic after a large number of times of switching [is adversely affected]; in particular, variability of the current chopping characteristic tends to increase. Also, large variability of the rate of occurrence of restriking after a large number of times of switching is produced. As described above, the mechanism of occurrence of the restriking phenomenon is as yet unknown, but, according to the experimental observations of the present inventors, restriking occurs with high frequency between one contact and another contact within the vacuum interrupter and between the contacts and the arc shield. Consequently, the present inventors, by suppressing the release of abrupt gas when for example the contacts are subjected to arcing, and by optimization of the form of the contact surface, demonstrated a technique that is very effective in suppressing occurrence of restriking and thereby greatly reduced the rate of occurrence of restriking. However, it appears that such improvement that is solely concerned with the contacts may already have reached its limit in regard to demands for higher voltage withstanding characteristic, larger current interrupter characteristic and smaller size that are being made in respect of vacuum interrupters in recent years, and some further improvement and optimization apart from these have become necessary.

Detailed analysis by the present inventors in simulated restriking tests have shown that this was related to cases in which there was direct involvement of the contact material, cases in which the design, such as the electrode construction, or shield construction was involved, and external mechanical/electrical conditions such as unpredictable exposure to high voltage. By carrying out simulated restriking tests involving the fitting and removal in a suitable vacuum interrupter of various structural members such as the ceramic insulating enclosure outer tube, contacts, arc shield, metal covers, conductive rod, sealing metal, and bellows, the present inventors discovered that the composition of the contacts directly subjected to arcing, their material and condition, as well as manufacturing conditions are important in regard to occurrence of restriking. In particular, they discovered that Cu—TiC, which is of high hardness and high melting point, is more advantageous than Cu—Bi, Cu—Te, or Cu—Cr alloys, which are observed to show considerable dispersion and release of fine metallic particles into the electrode space due to shock such as on making or interruption, owing to their brittle character. A further important discovery was that even materials which were alike insofar as they consisted of Cu—TiC showed a certain degree of variability in regard to dispersion and release of fine metallic particles into the electrode space. In the process of manufacturing the Cu—TiC, surface roughness such as in particular of the finished surface of the contacts should preferably be smooth, and a high sintering temperature tends to be beneficial in suppressing occurrence of restriking.

These observations and discoveries suggested the necessity of improvement of Ti—TiC alloy and the possibility of suppression of restriking. In this connection, the present inventors found that the presence of Fe under prescribed conditions in the Cu—TiC as an auxiliary constituent was beneficial in reducing dispersion and release of fine metallic particles into the electrode space on subjection to shock such as making or interruption. Normally, large numbers of fine projections (irregularities) are generated at the contact surface after making or interruption, and some of these are dispersed or exfoliated. However, in the present invention, due to the presence of Fe in the Cu—TiC, the strength of binding between Cu and TiC and the ductility (elongation) in extremely minute areas are improved. As a result, the benefits are obtained that the extent of occurrence of fine irregularities itself becomes small and there is some degree of rounding of the tips of the fine irregularities. As a result, the electric field intensification coefficient $\beta$ at the contact surface was improved from over 100 to under 100. This therefore suggests that the advantage of improvement in the electrical field intensification coefficient $\beta$ due to the presence of Fe and C in the Cu—TiC redoubles the improvement in mean surface roughness (Rave.) of the contact surface. Experiments in which vacuum interrupter contacts were prepared combining various conditions regarding sintering and infiltration and conditions regarding crushing, dispersion and mixing of the [Cu—Tic] mixed powder in the process of manufacturing Cu—TiC as described above showed that, in Cu—TiC in which high hardness and high melting point are maintained, optimization of mixing conditions, optimization of composition conditions, and optimization of sintering techniques are advantageous in suppressing restriking. In regard to optimization of mixing conditions, the method of uniform mixing of the raw material powder [Cu] and [TiC] and [C] shown in manufacturing examples 1~5 described below in particular, and the method of mixing involving performing mixing by combining rocking vibration and a stirring vibration in the raw material powder [Cu] and [TiC] were beneficial.

Specifically, the results of the observation of the time of occurrence of the restriking phenomenon by the inventors and its relationship with the material condition of the Cu—TiC suggested the importance of the manufacturing process in that it appeared that (i): the contact structure and their condition (segregation/uniformity) were correlated with optimization of the manufacturing process, in particular the mixing conditions and, characteristically, occurrence of the restriking phenomenon was observed at random, with no relationship to the number of times that current interruption switching had taken place; (ii): the amount and condition of gas or moisture adhering to or adsorbed on to the contact surface was a problem of environment management after processing of the previously finished contacts and was not directly related to sintering technology; however, occurrence of the restriking phenomenon was characteristically observed from a comparatively early stage in terms of number of times of current interruption switching; and (iii): the chief points regarding the condition of the interior of the contacts such as the content and condition of impurity incorporated in the interior of the contacts were the quality of the raw material powder (selection of Cu powder and TiC powder) and the mixing condition of the raw material; these appear to be causes of restriking occurring at a comparatively late period in terms of number of times of current interruption.

From the above, it was inferred that, although the time of occurrence of restriking was apparently unrelated to the number of times of current interruption, difference times of occurrence of restriking had different causes as explained under (i), (ii) or (iii) above. It appeared that this fact was a chief cause of the occurrence of variability in the appearance of restriking.

Consequently, in order to suppress or mitigate all of the times of occurrence of restriking, it is necessary to obtain a uniform, fine [Cu.WC] mixed powder by first obtaining raw material powders of [Cu] and [TiC] in a desirable quality condition, then crushing, dispersing and mixing these; it is further necessary to obtain the benefits of reduced generation of fine irregularities of the contact surface by making and interruption and of reduced release and dispersal of fine metallic particles into the electrode space, by the presence of suitable contents of C and/or Fe.

DETAILED DESCRIPTION OF THE PREFERRED EMBODIMENTS

Embodiments of the present invention are described in detail below.

The essence of the present invention consists in that, in a vacuum interrupter incorporating Cu—TiC contacts, regarding the presence of C as an auxiliary constituent, although, when the C content increases, the current chopping characteristic generally improves, the restriking characteristic generally deteriorates. In this way, in order to achieve simultaneously a good current chopping characteristic of the vacuum interrupter (i.e. lowered chopping and improved stability) and alleviation of the restriking phenomenon, which are in a mutually contradictory relationship, the C which is present in the Cu—TiC is put into a non-solid solution condition or a condition in which it does not form a (chemical) compound, and its content is controlled to be within the range 0.005~0.5 (weight %) with respect to the TiC content; and furthermore the size in which it is present in the contacts is kept within a range of 0.01~5 $\mu$m (diameter when calculated as a sphere): in this way the benefits described above can be obtained. The mean particle (grain) size of the C in the contact material of the Cu—TiC system, its content, and its degree of dispersion are therefore the important points.

Evaluation conditions and evaluation methods whereby the benefits of these example s have been ascertained are indicated below.

(1) Current Chopping Characteristic

Prescribed contacts of diameter 20 mm, thickness 4 mm whereof one side is flat and the other is of 50 mm R were mounted in a demountable current chopping test vacuum interrupter device. After evacuating to below $10^{-3}$ Pa and cleaning the contact surfaces by baking and discharge aging, the contacts of the device were parted with a parting speed of 0.8 m/sec. The chopping current value was found by observing the voltage drop of a coaxial shunt inserted in series with the contacts, in the initial period (1~100 times switching) and end period (19900~20000 times switching) of switching a circuit current of 50 Hz, effective value 44 A through an LC circuit. The measurement results are expressed as comparative values relative to the mean value of the chopping current of example 2, taken as 1.0. Smaller values of the chopping current value and smaller values of the range of variability imply a better current chopping characteristic.

(2) Restriking Characteristic

Disc-shaped contacts of diameter 30 mm, thickness 5 mm were mounted in a demountable vacuum interrupter; the frequency of occurrence of restriking when interruption of a 6 kV×500 A circuit was performed 1~1000 times or was performed 1001~20000 times are shown in Table 1, taking into account the variability of two interrupters (representing a total of six vacuum interrupters). In mounting the contacts, only baking heating (450° C.×30 minutes) was performed; use of hard solder and the concomitant heating were not performed. For the measurement results, the mean of the upper limiting values of six vacuum interrupters and the mean of the lower limiting values are shown. A better restriking characteristic means that the frequency of occurrence of this restriking is smaller and that the range of its variability is smaller.

(3) Resistance to Arc Erosion

The contacts were mounted on a demountable vacuum interrupter device and subjected to the same fixed conditions in terms of baking of the contact electrode surface, current and voltage aging and speed of parting, and the weight lost from the surface irregularities was then calculated before and after 1000 times of interruption of 7.2 kV and 4.4 kA. Relative values are shown, taking the value of example 2 as 1.0.

(4) Example of Method of Manufacturing Contacts

An example of a method provided for manufacturing contact material according to the present example will now be described.

Methods of manufacturing this contact material may be generally divided into infiltration methods, in which Cu is melted and caused to flow into a skeleton constituted of Ti and C, and sintering methods, in which a powder consisting of a mixture of TiC and C powder and Cu powder mixed in prescribed ratio is sintered or molded and sintered.

In this example, both a good current chopping characteristic and good restriking characteristic are obtained by optimizing the condition in which C, which is considered to be one of the keys to the rate of occurrence of restriking is present in the Cu—TiC alloy (i.e. its condition as regards non-solid state or condition in which it does not form a chemical compound) and the content thereof. The method of manufacturing the Cu—TiC alloy is therefore also important, since this controls the condition in which the C is present in the Cu—TiC alloy.

Specifically, for the optimum TiC powder for putting the present invention into practice, the C content which is in non-solid solution or condition in which it does not form a chemical compound, its particle size and particle size distribution are adjusted by controlling for example the heat treatment temperature and time and atmosphere etc., and TiC is selected stoichiometrically in the range ($TiC_{1\ 0.7}$) $TiC_x$ (where X is 1~0.7)means essentially that Ti:C=1:0.7). Apart from the method of heat treatment of TiC powder as described above, a method of achieving an extremely small controlled content of C (in non-solid solution condition or condition in which it does not form a chemical compound) is for example by means of decomposition and precipitation on to the surface of TiC of C produced by pyrolysis of certain types of organic compound together with the TiC. The method of attaching a C sputtered film on to the surface of TiC and then using this for the raw material TiC may also be selected.

When the content and size of such C in the Cu—TiC alloy (in non-solid solution condition or in condition in which does not form a chemical compound) is made large, the rate of occurrence of restriking tends to increase (deterioration of the characteristic). It should also be noted that when the total content of TiC in the Cu—TiC alloy is made large, the rate of occurrence of restriking likewise tends to increase (deterioration of characteristic).

Since the C content is extremely small in comparison with the TiC content and Cu content, achieving uniform mixing thereof in the method of manufacture of the Cu—TiC alloy is an important challenge. As a means of achieving a mixture of good uniformity, according to the present invention, for example a very small quantity of TiC extracted from part of the TiC content (30~70 volume %) that will finally be required is mixed together with C powder (preferably in an approximately equal volume) (if necessary, at least one of Bi, Sb or Te may be added. And Fe, Co, Ni, Cr may be treated in the same way) to obtain a primary mixed powder (if necessary this may be repeated up to the n-th mixing). This primary mixed powder (or n-th mixed powder) and the remaining TiC powder are again mixed, so that finally [TiC, C] powder in a fully satisfactory condition is obtained. This [TiC, C] powder and a prescribed quantity of Cu powder are mixed and then sintering and pressurization are carried out one or more times in combination in a hydrogen atmosphere (a vacuum is also possible) at for example a temperature of 930° C., to manufacture Cu—TiC—C contact blanks (or Cu—TiC—Co—C, Cu—TiC—Fe—C, Cu—TiC—Ni—C, Cu—TiC—Co—Fe—C, Cu—TiC—Co—C—Bi contact blanks etc.) (hereinbelow referred to by way of example as Cu—TiC—C). Contacts are then obtained by processing to a suitable shape (example method of manufacture 1).

As another method of alloying, in contrast, a very small amount of Cu may be extracted from some of the Cu content which will finally be required and mixed with C powder (preferably in approximately equal volume) (if necessary, Bi may be added, or, if necessary, Fe, Co, Ni, or Cr may be likewise treated) to obtain a primary mixed powder (if necessary this may be repeated to the n-th mixing). This primary mixed powder (or n-th mixed powder) and the remaining Cu powder are again mixed to obtain finally a [Cu, C] powder in fully satisfactorily mixed condition. After mixing this [Cu, C] powder and a prescribed amount of TiC powder (the finally required TiC content), the mixture is subjected once or a plurality of times in combination to sintering and pressurization at a temperature of for example 940° C. under a hydrogen atmosphere (vacuum is also possible), to manufacture Cu—TiC—C contact blanks or Cu—TiC—C—Bi contact blanks (example method of manufacture 2).

As another method of manufacture an n-th mixture [TiC, C] powder manufactured by a method as above or a [TiC, Co, C] powder is sintered at a temperature of 1200° C. to manufacture a {TIC, C} skeleton having a prescribed porosity ratio and, into these pores, Cu (if necessary Bi may also be added) is infiltrated at a temperature of for example 1150° C., to manufacture a Cu—TiC—C contact blank or Cu—TiC—C—Bi contact blank (example method of manufacture 3).

And as another method of alloying, [TiC, C] powder or [TiC, Co, C] powder is sintered at a temperature of 1500° C. and a skeleton having a prescribed porosity ratio is thereby manufactured; Cu that has been prepared separately is then infiltrated into these pores at a temperature of for example 1550° C., to manufacture Cu—TiC—C blanks (example method of manufacture 4).

As a further method of alloying, C-coated Ti powder is obtained by coating the surface of Ti powder with C (if necessary simultaneously with Bi) by a physical method using an ion plating device or a mechanical method using a ball mill device; this C-coated Ti powder and Cu powder (if necessary with simultaneous addition of Bi) are then mixed and subjected once or a combination of a plurality of times to sintering and pressurization at a temperature of for example 1050° C. under a hydrogen atmosphere (vacuum is also possible), to manufacture Cu—TiC—C contact blanks or Cu—TiC—C—Bi contact blanks (example method of manufacture 5).

Also, as another method of alloying, in particular in techniques for uniformly mixing Cu power, TiC powder and C powder, a method in which rocking vibration and stirring vibration are superimposed is beneficial. By this means, the phenomenon of formation of lumps or aggregations that is seen when the mixed powder is employed with the usually employed solvents such as acetone is eliminated and ease of processing is increased. There is also the characteristic advantage that if the ratio R/S of the speed of stirring R of the stirring vibration of the stirring container in the mixing operation and the speed of vibration S of the rocking vibration applied to the stirring container is selected within a preferred range of approximately 10~1.0, the energy input to the powder during crushing, dispersal and mixing is in a preferred range, with the result that denaturing and/or contamination of the powder in the mixing operation can be suppressed to a low level. With a conventional mixer or the like, a crushing action is performed by mixing and crushing, but, with the present method in which rocking vibration and stirring vibration are superimposed, distribution is achieved with the aforementioned R/S ratio of about 10~0.1, so a mixture is produced in which the powders are intertwined with each other, with the result that excellent gas permeability is achieved and sintering properties are improved, enabling excellent moldings or sintered bodies or skeletons to be obtained. Furthermore, since there is no energy input beyond what is necessary, there is no denaturing of the powders. If a mixed powder in such a condition is employed as raw material, low evolution of gas from the alloy after sintering and infiltration can be achieved; this contributes to stabilization of interruption performance and restriking performance (example method of manufacture 6). The same method of manufacture may also be selected in the case of Cu—VC—C.

In the present examples, these methods may be suitably selected and applied; whichever technique is chosen, contact materials exhibiting the benefits of the present invention can be obtained.

Hereinbelow, the evaluation conditions are summarized as Table 1 and Table 2, and the results are summarized as Table 3 and Table 4.

TABLE 1

| | Conditions | | | | | | | | | | |
|---|---|---|---|---|---|---|---|---|---|---|---|
| | Composition of contacts (Cu and TiC are in volume %, other constituents as weight % with respect to the TiC content) | | | | | | | | | | |
| | Chief constituents | | | Auxiliary constituents | | | | Mean particle size diameter (μm) | | | |
| Comparative example | Cu (volume %) | TiC (volume %) | C content in non-solid solution condition or condition in which it does not compound | Co | Fe | Ni | Cr | TiC | Co Fe Ni Cr | | Particle size/ aggregations of C in non-solid solution condition or condition in which it does not form a chemical compound |
| Comparative example 1 | Balance | 20 | 0.05 | 09 | None | None | None | 1.3 | Co: 1 | | 0.05 |
| Example 1 | " | 30 | " | " | " | " | " | " | : 5 | | " |
| Example 2 | " | 50 | " | " | " | " | " | " | " | | " |
| Example 3 | " | 70 | " | " | " | " | " | " | " | | " |
| Comparative example 2 | " | 80 | " | " | " | " | " | " | " | | " |
| Comparative example 3 | " | 50 | Less than 0.005 | " | " | " | " | " | " | | " |
| Example 4 | " | " | 0.005 | " | " | " | " | " | " | | " |
| Example 5 | " | " | 0.5 | " | " | " | " | " | " | | " |
| Comparative example 4 | " | " | 1.5 | " | " | " | " | " | " | | " |
| Example 6 | " | " | 0.05 | 0 | " | " | " | " | 0 | | 0.05 |
| Example 7 | " | " | " | 0.2 | " | " | " | " | " | | " |
| Example 8 | " | " | " | 5.0 | " | " | " | " | Co: 5 | | " |
| Comparative example 5 | " | " | " | 10.0 | " | " | " | " | " | | " |
| Example 9 | " | | " | None | 0.5 | " | " | " | " | | " |
| Example 10 | " | " | " | " | none | 0.5 | " | " | " | | " |
| Example 11 | " | " | " | " | " | none | 0.5 | " | " | | " |
| Comparative example 6 | " | " | " | 0.9 | " | " | None | Less than 0.01 | " | | " |
| Example 12 | " | " | " | " | " | " | " | 0.01 | " | | " |
| Example 13 | " | " | " | " | " | " | " | 0.1 | " | | " |
| Example 14 | " | " | " | " | " | " | " | 1.0 | " | | " |
| Example 15 | " | " | " | " | " | " | " | 5.0 | " | | " |
| Comparative example 7 | " | " | " | " | " | " | " | 10.0 | " | | " |
| Example 16 | " | " | " | " | " | " | " | 1.3 | Ni: 5 | | " |
| Example 17 | " | " | " | " | " | " | " | " | Fe: 10 | | " |
| Example 18 | " | " | " | " | " | " | " | " | Cr: 0.1 | | " |
| Example 19 | " | " | " | " | " | " | " | " | Cr: 2.0 | | " |
| Comparative example 8 | " | " | " | " | " | " | " | " | Cr: 44.0 | | " |
| Example 20 | " | " | " | " | " | " | " | " | Co: 5 | | 0.01 |
| Example 21 | " | " | " | " | " | " | " | " | " | | 0.1 |
| Example 22 | " | " | " | " | " | " | " | " | " | | 1.0 |
| Example 23 | " | " | " | " | " | " | " | " | " | | 5.0 |
| Comparative example 9 | " | " | " | " | " | " | " | " | " | | 25.0 |
| Example 24 | " | " | " | " | " | " | " | " | " | | 0.05 |
| Example 25 | " | " | " | " | " | " | " | " | " | | " |
| Comparative example 10 | " | " | " | " | " | " | " | " | " | | " |
| Example 26 | " | " | " | " | " | " | " | " | " | | " |
| Comparative example 11 | " | " | " | " | " | " | " | " | " | | " |
| Comparative example 12 | " | " | " | " | " | " | " | " | " | | " |
| Example 27 | " | " | " | " | " | " | " | " | " | | " |
| Example 28 | " | " | " | " | " | " | " | " | " | | " |
| Example 29 | " | " | " | " | " | " | " | " | " | | " |
| Comparative example 13 | " | " | " | " | " | " | " | " | " | | " |

TABLE 2

| Example Comparative example | Conditions: Form TiC forming carbides in Cu—TiC alloy | Degree of dispersion of C particles (separation between most closely adjacent C particle) The separation L of the two most closely adjacent C particles is more than the particle size d L > d; X Separation is about the same d, or more L ≧ d; Y The particle size is larger L < d; Z | Contacting surface (range having the composition that exhibits function as a contact material): Thickness (mm) | Mean Surface Roughness (Rave.) (μm) |
|---|---|---|---|---|
| Comparative example 1 | $TiC_{1.0}$ | X | 3 | 0.3 |
| Example 1 | " | X | " | " |
| Example 2 | " | " | " | " |
| Example 3 | " | " | " | " |
| Comparative example 2 | " | X~Y | " | " |
| Comparative example 3 | " | X | " | " |
| Example 4 | " | " | " | " |
| Example 5 | " | " | " | " |
| Comparative example 4 | " | " | " | " |
| Example 6 | " | " | " | " |
| Example 7 | " | " | " | " |
| Example 8 | " | " | " | " |
| Comparative example 5 | " | " | " | " |
| Example 9 | " | " | " | " |
| Example 10 | " | " | " | " |
| Example 11 | " | " | " | " |
| Comparative example 6 | " | " | " | " |
| Example 12 | " | " | " | " |
| Example 13 | " | " | " | " |
| Example 14 | " | " | " | " |
| Example 15 | " | " | " | " |
| Comparative example 7 | " | " | " | " |

TABLE 2-continued

| Example Comparative example | Conditions: Form TiC forming carbides in Cu—TiC alloy | Degree of dispersion of C particles (separation between most closely adjacent C particle) The separation L of the two most closely adjacent C particles is more than the particle size d L > d; X Separation is about the same d, or more L ≧ d; Y The particle size is larger L < d; Z | Contacting surface (range having the composition that exhibits function as a contact material): Thickness (mm) | Mean Surface Roughness (Rave.) (μm) |
|---|---|---|---|---|
| Example 16 | " | " | " | " |
| Example 17 | " | " | " | " |
| Example 18 | " | " | " | " |
| Example 19 | " | " | " | " |
| Comparative example 8 | " | " | " | " |
| Example 20 | " | " | " | " |
| Example 21 | " | " | " | " |
| Example 22 | " | " | " | " |
| Example 23 | " | " | " | " |
| Comparative example 9 | " | " | " | " |
| Example 24 | $TiC_{0.95}$ | " | " | " |
| Example 25 | $TiC_{0.70}$ | " | " | " |
| Comparative example 10 | $TiC_{0.55}$ | " | " | " |
| Example 26 | $TiC_{1.0}$ | Y | " | " |
| Comparative example 11 | " | Z | " | " |
| Comparative example 12 | " | X | 0.05 | " |
| Example 27 | " | " | 0.3 | " |
| Example 28 | " | " | 3 | 0.05 |
| Example 29 | " | " | " | 10.0 |
| Comparative example 13 | " | " | " | 36.0 |

TABLE 3

| Example Comparative example | Conditions: Current chopping characteristic Interruption of 50 Hz, root mean square value 44A: Chopping characteristic on switching 1~100 times: Mean | Maximum | Chopping characteristic on switching 19,900~20,000 times: Mean | Maximum | Rate of occurrence restriking (%): Rate of occurrence of restriking when interrupting 1,000 times a circuit of 6 KV × 500A: 2 interrupters (comprising 6 vacuum valves; mean of lower limiting value and mean of upper limiting value) (× $10^{-3}$ (%)) | Rate of occurrence of restriking when interrupting 20,000 times a circuit of 6 KV × 500A: 2 interrupters (comprising 6 vacuum valves; mean of lower limiting value and mean of upper limiting value) (× $10^{-3}$ (%)) |
|---|---|---|---|---|---|---|
| Comparative example 1 | 1.6 | 2.1 | 1.95 | 2.55 | 14~28 | 35~7.37 |
| Example 1 | 1.1 | 1.4 | 1.45 | 1.55 | 0.6~3 | 0.9~1.8 |
| Example 2 | 1.0 | 1.35 | 1.3 | 1.45 | 0.2~0.8 | 0.3~0.6 |
| Example 3 | 0.9 | 1.15 | 1.15 | 1.2 | 0.8~4 | 0.2~2.5 |
| Comparative example 2 | 0.7 | 0.9 | 1.05 | 1.15 | 26~55 | 28~62 |
| Comparative | 1.2 | 1.4 | 1.5 | 2.15 | 12~18 | 12~32 |

TABLE 3-continued

| Example Comparative example | Conditions: Current chopping characteristic Interruption of 50 Hz, root mean square value 44A: Chopping characteristic on switching 1~100 times: Mean | Maximum | Chopping characteristic on switching 19,900~20,000 times: Mean | Maximum | Rate of occurrence restriking (%): Rate of occurrence of restriking when interrupting 1,000 times a circuit of 6 KV × 500A: 2 interrupters (comprising 6 vacuum valves; mean of lower limiting value and mean of upper limiting value) ($\times 10^{-3}$ (%)) | Rate of occurrence restriking (%): Rate of occurrence of restriking when interrupting 20,000 times a circuit of 6 KV × 500A: 2 interrupters (comprising 6 vacuum valves; mean of lower limiting value and mean of upper limiting value) ($\times 10^{-3}$ (%)) |
|---|---|---|---|---|---|---|
| example 3 | | | | | | |
| Example 4 | 1.05 | 1.3 | 1.25 | 1.55 | 0.4~2 | 0.6~1.8 |
| Example 5 | 0.95 | 1.3 | 1.15 | 1.4 | 0.7~3 | 0.6~2.4 |
| Comparative example 4 | 0.8 | 1.3 | 1.1 | 1.15 | 54~69 | 44~77 |
| Example 6 | 0.95 | 1.3 | 1.2 | 1.4 | 0.4~0.6 | 0.6~1.0 |
| Example 7 | 0.8 | 1.2 | 1.1 | 1.3 | 0.4~1.4 | 0.7~1.6 |
| Example 8 | 1.3 | 1.5 | 1.4 | 1.6 | 0.6~1.4 | 0.9~1.8 |
| Comparative example 5 | 1.75 | 2.4 | 2.4 | 3.9 | 8~32.6 | 10~46 |
| Example 9 | 1.8 | 1.2 | 1.1 | 1.25 | 0.3~0.6 | 0.4~0.9 |
| Example 10 | 1.8 | 1.2 | 1.1 | 1.2 | 0.4~0.6 | 0.4~0.8 |
| Example 11 | 1.85 | 1.35 | 1.25 | 1.44 | 0.4~0.6 | 0.5~0.9 |
| Comparative example 6 | 0.9 | 1.0 | — | — | Insufficient stability material for . . . | . . . mass production of contacts |
| Example 12 | 0.9 | 1.0 | 1.2 | 1.3 | 0.1~0.4 | 0.2~0.4 |
| Example 13 | 0.95 | 1.15 | 1.3 | 1.45 | 0.1~0.6 | 0.3~0.6 |
| Example 14 | 1.05 | 1.25 | 1.4 | 1.6 | 0.2~0.6 | 0.4~0.6 |
| Example 15 | 1.2 | 1.7 | 1.55 | 1.8 | 0.3~0.9 | 0.5~0.9 |
| Comparative example 7 | 1.35 | 1.65 | 1.6 | 5.2 | 8~21 | 8~28 |
| Example 16 | 1.1 | 1.55 | 1.4 | 1.7 | 0.4~0.6 | 0.4~0.8 |
| Example 17 | 1.1 | 1.55 | 1.4 | 1.7 | 0.4~0.6 | 0.6~0.8 |
| Example 18 | 1.15 | 1.65 | 1.4 | 1.6 | 0.4~0.6 | 0.6~1.0 |
| Example 19 | 0.95 | 1.2 | 1.5 | 1.7 | 0.2~1.2 | 0.4~1.2 |
| Comparative Example 8 | 2.2 | 2.8 | 1.95 | 3.6 | 12~28 | 18~34 |
| Example 20 | 0.8 | 1.0 | 1.15 | 1.2 | 0.1~0.2 | 0.1~0.3 |
| Example 21 | 0.9 | 1.05 | 1.2 | 1.3 | 0.2~0.9 | 0.4~1.2 |
| Example 22 | 0.9 | 1.3 | 1.3 | 1.45 | 0.3~1.0 | 0.5~1.6 |
| Example 23 | 0.9 | 1.55 | 1.55 | 1.75 | 0.4~1.2 | 0.6~1.8 |
| Comparative example 9 | 0.9 | 3.0 | 3.0 | 5.05 | 30~54 | 38~56 |
| Example 24 | 1.0 | 1.35 | 1.3 | 1.45 | 0.2~0.8 | 0.2~1.2 |
| Example 25 | 12 | 1.55 | 1.65 | 1.7 | 0.3~1.0 | 0.4~1.6 |
| Comparative example 10 | 1.4 | 1.85 | 2.4 | 4.8 | 2.6~5.8 | 2.8~7.4 |
| Example 26 | 1.05 | 1.45 | 1.5 | 1.6 | 0.2~1.0 | 0.2~1.2 |
| Comparative example 11 | 1.3 | 1.55 | 1.5 | 3.85 | 5~12 | 6~22 |
| Comparative example 12 | 1.0 | 1.1 | — | — | Contacts cracked and broke during switching | Contacts cracked and broke during switching |
| Example 27 | 1.0 | 1.1 | 1.25 | 1.35 | 0.2~0.8 | 0.3~0.6 |
| Example 28 | 1.0 | 1.1 | 1.3 | 1.4 | 0.1~0.4 | 0.2~0.5 |
| Example 29 | 1.2 | 1.55 | 1.3 | 1.45 | 0.25~0.6 | 0.3~0.8 |
| Comparative example 13 | 1.3 | 1.8 | 1.4 | 3.0 | 6.4~18.8 | 10.4~20.2 |

TABLE 4

| Example Comparative example | Conditions: Test of erosion — Resistance characteristic Weight loss interrupting 7.2 KV, 4.4 KA; (relative values taking example 2 as 1.0) | Conditions: Notes — Material observations (microscopic (observation of surface after evaluation test) | Conditions: Notes — Overall evaluation Good: ○ Poor: X |
|---|---|---|---|
| Comparative example 1 | 1.05~1.2 | | X |
| Example 1 | 0.95~1.05 | | ○ |
| Example 2 | 1.0 | | ○ |
| Example 3 | 0.95~1.1 | | ○ |
| Comparative example 2 | 3.6~6.6 | Marked exfoliation of C | X |
| Comparative example 3 | 0.8~0.9 | | X |
| Example 4 | 0.85~0.95 | | ○ |
| Example 5 | 1.0~1.1 | | ○ |
| Comparative example 4 | 3.4~4.6 | Depletion layer of Cu at Contact surface, aggregation and exfoliation of TiC | X |
| Example 6 | 2.6~3.1 | | ○ |
| Example 7 | 0.9~1.1 | | ○ |
| Example 8 | 0.95~1.25 | | ○ |
| Comparative example 5 | 3.9~8.6 | Excess Co causes aggregation and exfoliation of TiC | X |
| Example 9 | 0.95~1.05 | | ○ |
| Example 10 | 0.95~1.05 | | ○ |
| Example 11 | 0.95~1.05 | | ○ |
| Comparative example 6 | 1.05~1.3 | | |
| Example 12 | 1.1~1.2 | | ○ |
| Example 13 | 1.1~1.25 | | ○ |
| Example 14 | 0.95~1.05 | | ○ |
| Example 15 | 1.8~2.0 | | ○ |
| Comparative example 7 | 9.05~12.6 | | X |
| Example 16 | 1.0~1.1 | | ○ |
| Example 17 | 1.0~1.1 | | ○ |
| Example 18 | 1.0~1.1 | | ○ |
| Example 19 | 0.95~1.1 | | ○ |
| Comparative example 8 | 10.6~21.8 | | X |
| Example 20 | 0.75~0.9 | | ○ |
| Example 21 | 0.85~1.0 | | ○ |
| Example 22 | 1.2~1.35 | | ○ |
| Example 23 | 1.35~1.75 | | ○ |
| Comparative example 9 | 19.6~42.8 | | X |
| Example 24 | 1.0~1.05 | | ○ |
| Example 25 | 1.05~1.1 | | ○ |
| Comparative example 10 | 18.4~24.8 | | X |
| Example 26 | 1.0~1.1 | | ○ |
| Comparative example 11 | 4.6~11.6 | Evaluation partially Interrupted | X |
| Comparative example 12 | Discontinuance | | X |
| Example 27 | 0.95~1.0 | | ○ |
| Example 28 | 0.9~1.1 | | ○ |
| Example 29 | 1.0~1.3 | | ○ |
| Comparative example 13 | 6.2~20.6 | | X |

Next, embodiments of the present invention will be described in detail with reference to Table 1 to Table 4.

(Examples 1~3, Comparative Examples 1~2)

First of all, an outline of the assembly of an experimental valve for an interruption test will be described. A ceramic insulating container (chief constituent: $Al_2O_3$) whose mean surface roughness of the end faces was ground to about 1.5 μm was prepared, and pre-heating treatment at 1650° C. was performed before assembly with respect to this ceramic insulating container.

42% Ni—Fe alloy of sheet thickness 2 mm was prepared for use as sealing metal. 72% Ag—Cu alloy sheet of thickness 0.1 mm was prepared for use as hard solder.

The members prepared as above were arranged such that a gas-tight sealed joint could be effected between the articles to be joined (the end face of the ceramic insulating container and the sealing metal), and supplied to a gas-tight sealing step in which the sealing metal and ceramic insulating container were sealed under a vacuum atmosphere of $5\times10^{-4}$ Pa.

Contact blanks consisting of 20~80 volume % TiC—Co—C balance Cu were prepared (examples 1~3, comparative examples 1~2), making a suitable selection of methods of manufacture 1~6 described above, using Cu—TiC alloy, employing $TiC_{1.0}$ powder of mean particle (grain) size 1.3 μm, C of mean particle (grain) size 0.05 μm (C in a non-solid solution condition or condition in which it does not form a chemical compound) in the amount of 0.05 weight %, and Co of particle size 1~10 μm in the amount of 0.9 weight %.

For the sample contacts, Cu—TiC—C alloy was selected in which the C content was 0.05%, when this C was in a non-solid solution condition or condition in which it did not form a chemical compound, by observation of the structure using a microscope, from the contact blanks that were manufactured on a trial basis.

These blanks were processed to a prescribed shape with a thickness of 3 mm and a mean surface roughness of the contact faces of 0.3 μm to provide test pieces. The current chopping characteristic, restriking characteristic and erosion resistance of these test pieces were measured and compared with the characteristics of example 2, which was taken as standard. The results obtained are shown in the Tables. In these examples, for convenience, TiC and balance Cu are given as volume percentages, while the other elements, for convenience in manufacture, were expressed as weight percentages (with respect to the TiC content).

When the TiC content was 30~70 volume %, the current chopping characteristic, the rate of occurrence of restriking, and erosion resistance all showed excellent characteristics (examples 1~3).

However, when the Cu—TiC—C alloy in which the TiC content was 20 weight % and the balance Cu (comparative example 1) was evaluated in the same way, although the erosion resistance was in the preferred range with an erosion of about 1.05~1.2 times that of example 2, which was taken as standard, when an evaluation was performed of the current chopping characteristic, it was found that, although there was only a drop of the characteristic in the initial switching range (in switching 1~100 times), in the latter period of switching (in switching 19900~20000 times), the current chopping value had increased by about twice (i.e. the characteristic had deteriorated). Also, a large increase (deterioration of the characteristic) and variability were observed in the rate of occurrence of restriking. Specifically, comparing the frequency of occurrence of restriking of comparative example 1 with the frequency of occurrence of restriking on 1000 times of interruption of example 2, which was taken as reference, it was found that in comparative example 1 the rate of occurrence of restriking on 1000 times of interruption had increased by a factor of 35~70 times (lowering of characteristic), and, on 20000 times of interruption, had increased to 12~116 times (deterioration of characteristic).

In contrast, when the same evaluation was performed in respect of Cu—TiC—C alloy wherein the TiC content was 80 volume %, balance Cu (comparative example 2), it was found that, although the current chopping value in the initial period of switching (during switching 1~100 times) and in the latter period of switching (during switching 19900~20000 times) showed excellent characteristics comparable with or better than the characteristic of example 2 which was taken as reference, there was a large increase (deterioration of characteristic) and variability in regard to the rate of occurrence of restriking and the erosion resistance. Specifically, on comparing the frequency of occurrence of restriking of comparative example 2 with the frequency of occurrence of restriking at 1000 times of interruption of example 2 which was taken as reference, it was found that in the case of comparative example 2 this had increased to 70~130 times (deterioration of characteristic) on 1000 times of interruption and had greatly increased, to 93~103 times (deterioration of characteristic) on interrupting 20000 times. The erosion resistance of comparative example 2 (i.e. the change in weight after interrupting 7.2 kV, 4.4 kA, 1000 times) was 3.6~6.6 times that found in the case of example 2, which was taken as standard.

On examination using a microscope, scattered locations where Cu was absent, and also aggregations of TiC and exfoliation of TiC were observed in the contact surface. It can therefore be seen that, in order to obtain a balance of restriking characteristic, current chopping characteristic and erosion resistance, the range: TiC content 30~70 volume % shown in example 1~3 is beneficial.

(Examples 4~5, Comparative Examples 3~4)

Although, in the examples 1~3 and comparative examples 1~2 described above, the C content in a non-solid solution condition or condition in which it does not form a chemical compound was taken as 0.05 weight % and the effects of the TiC content on the various characteristics when the mean particle (grain) size (diameter assuming the particles to be circular) of the TiC was taken as 1.3 $\mu$m was indicated, benefits are still displayed even if the C content which is in non-solid solution condition or condition in which it does not form a chemical compound is not restricted to 0.05 weight %.

Specifically, Cu—TiC—C alloys with a C content as referred to above of under 0.005 weight % or 0.05 weight %~1.5 weight % were manufactured, selecting a method as described above.

In the case of Cu—TiC—C alloy (comparative example 3) where the C content was less than 0.05 weight %, comparing the current chopping characteristics in the initial period of switching (during switching 1~100 times) and the latter period of switching (during switching 19900~20000 times), a desirable current chopping value and low fluctuation width were displayed within the allowed range, and the erosion resistance of the contacts was also excellent; however, in contrast, regarding the restriking characteristic on interrupting a circuit of 6 kV×500 A 20000 times, the rate of occurrence of restriking showed an enormous increase in comparison with that found for interruption 1000 times and furthermore the variability had also greatly increased. This was therefore undesirable.

On observation of the surface using a microscope, it was observed that, in the case of contacts whose restriking characteristic was evaluated after switching 20000 times, slight irregularities of the contact surface existed over a wide range, showing surface damage due to insufficiency of C content, and scars due to dispersal of Cu.

In contrast, in which the C content as described above was 0.005 weight %~0.5 weight % showed excellent characteristics in respect of all of current chopping characteristics, rate of occurrence of restriking and erosion resistance. Specifically, the case of Cu—TiC alloy in which the C content was 0.005 weight %~0.5 weight % (examples 4~5) showed a frequency of restriking in the allowed range of under 0.4~3 %. Furthermore, the restriking characteristic was in a desired range of the same level as example 2, the erosion resistance showed relative values in an allowed range of 0.85~1.1, and, in regard to changes occurring with number of times of switching, all of the current chopping characteristic, restriking characteristic and erosion resistance showed stable characteristics. When the contact surface that had been subjected to evaluation of restriking characteristic on switching 20000 times was examined using a microscope, the contact surface was observed to be in a smoother condition than that of comparative example 3 over a wide range, thanks to the distribution effect of C under prescribed conditions.

In contrast, when the same evaluation was conducted in respect of Cu—TiC—C alloy (comparative example 4) in which the content of C as described above was 1.5 weight %, although the current chopping characteristic, even on comparing the initial switching period (1~100 times of switching) and the latter switching period (19900~20000 times of switching), was in an allowed range showing desirable chopping values and a low range of fluctuation, the erosion resistance of the contacts when subjected to interruption of 7.2 kV×4.4 kA 1000 times was much larger than in the case of example s 1~2 and comparative example 1, with considerable variability between contacts; also the restriking characteristic when a circuit of 6 kV×500 A was interrupted 20000 times showed a greatly increased rate of occurrence of restriking than in the case of interruption for 1000 times, and its variability was also large. This was therefore undesirable. On using a microscope to observe the surface of contacts whose restriking characteristic had been evaluated by switching 20000 times, it was found that, in the contact surface, severe irregularities were present showing scars produced by dispersion and volatilization of Cu over a wide range, and irregularities due to giant and exfoliation scars of C in the interrupter surface were also observed. As a result of examination with a microscope, a Cu depletion layer and aggregation and exfoliation of TiC in the contact surface were observed. From the above results it may be concluded that benefits are obtained when the C content in Cu—TiC—C which is in a non-solid solution condition or condition not forming a chemical compound is in the range 0.005~0.5%.

As a result of these observations, it was found that even if the C content in the Cu—TiC—C is the same, it is beneficial if the prescribed quantity of C is in a non-solid solution condition or condition in which it does not form a chemical compound such as a carbide (i.e. condition according to the present invention), in that, even after a large number of times of switching, a good current chopping characteristic is maintained, and in addition, there is a low frequency of restriking and a small range of variability. That is, it was shown that what is important regarding the C content is not the total C content but rather the C content which is in non-solid solution condition or condition in which it does not form a chemical compound. In contrast, in the case of Cu—TiC—C in which the C is not in a non-solid solution condition or a condition in which it does not form a chemical compound such as a carbide, contact surface roughness tends to increase as the number of times of switching increases, and there is an increase in frequency of occurrence of restriking. Considerable variability was also observed in the frequency of occurrence of restriking between a plurality of blanks. Increase in the amount of contact erosion was also seen.

From the above, it may be concluded that, in order to obtain a balance between restriking characteristic, current chopping characteristic and erosion resistance, a C content in the alloy in non-solid solution condition or condition in which it does not form a chemical compound shows benefits in the range 0.005 weight %~0.5 weight % shown in examples 3~4.

(Examples 6~8, Comparative Example 5)

Although benefits according to the present invention were displayed when the Co content in the Cu—TiC alloy was fixed at 0.9% in examples 1~5 and comparative examples 1~4 described above, these benefits are not restricted to this Co content. Specifically, in the case of 50 volume % TiC balance Cu alloy (examples 6~8) in which the Co content was zero or was 0.2~10.0 weight %, on performing the same evaluation, it was found that the rate of occurrence of restriking was in the desired range of $0.4\sim1.8\times10^{-3}$% and, in particular, even on comparing the cases where the number of times of interruption was 1000 times and 20000 times, there was no marked difference between these two and little variability.

The current chopping characteristic was also in the allowed range, showing desired values of 0.8~1.5 A in the initial period of switching (during switching 1~100 times) and 1.1~1.6 A during the latter period of switching (during switching 19900~20000 times), and a low range of fluctuation was also shown.

The erosion resistance was also within the range of 0.9~3.1 times compared with example 2.

However, when 50 weight % TiC balance Ag alloy (comparative example 5) in which the Co content was 10% was likewise evaluated, it was found that there was a considerable increase in the current chopping value (i.e. deterioration of characteristic). The reasons for this are believed to be increase in the conductivity of the alloy itself due to the presence of a Co content of 10% and a lowering of the capability of thermion emission of the TiC itself. Furthermore, on comparing the frequency of occurrence of restriking of comparative example 4 with the frequency of occurrence of restriking on interruption 1000 times of example 2 described above, it was found that in the case of example 3 this had increased to 1.7~3 times for 1000 times of interruption (deterioration characteristic) and had increased to 2~3 times for 20000 times of interruption.

According to the results of microscopic examination, it is believed that Co at more than a certain level of content is present as excess Co in the structure, tending to cause increase in particle size due to coagulation of the C within the structure, and the resulting C segregation increases the frequency of occurrence of restriking. Consequently, in order to obtain a balance of restriking characteristic, current chopping characteristic and erosion resistance, it is effective to make the upper limit of Co content shown in example 7 5% (including the case where the Co content is zero, as shown in example 1 described above) in the Cu—TiC contacts.

(Examples 9~11)

In examples 6~8 and comparative example 5, the characteristics of Cu—TiC—C alloy employing Co as auxiliary constituent were shown. However, similar current chopping characteristic, restriking characteristic and erosion resistance to those of example 2, which is taken as standard, are shown when Fe, Ni or Cr are used (examples 9~11).

(Examples 12~15, Comparative Examples 6~7)

The beneficial effects of the present invention were shown with reference to examples 1~11 and comparative examples 1~5 when the mean particle (grain) size (diameter assuming that the particles are spherical) of the TiC particles in Cu—TiC—C alloy or Cu—TiC—Co—C alloy was made 1.3 μm, but these benefits are not restricted to where the mean particle (grain) size has this value.

(Examples 6~19, Comparative Example 8)

In examples 1~15 and comparative examples 1~7, examples were illustrated in which Co of particle size 1~5 μm was selected and sintered as an auxiliary constituent in Cu—TiC—C alloy in order to obtain even stronger contact blanks.

In the present invention, with a TiC particle size of 1.3 μm, the same benefits are obtained even if Fe or Ni are selected as auxiliary constituent instead of Co. Specifically, in the case of use of Ni of particle size 5 μm or Fe of particle size 10 μm as auxiliary constituents, all of the chopping characteristic, rate of occurrence of restriking and erosion resistance showed practically the same characteristics as in the case of example 2, which was taken as standard (examples 16~17). The same benefits are obtained even when Cr is selected as auxiliary constituent. Specifically, in the case where Cr of particle size 0.1~2 μm is selected as auxiliary constituent, all of the chopping characteristic, rate of occurrence of restriking and erosion resistance showed practically equivalent characteristics to those of example 2, which was taken as standard (examples 18~19).

However, in the case of use of Cr of particle size 44 μm as auxiliary constituent, when an evaluation as above was performed, it was found that, in the initial switching range (during switching 1~100 times), the chopping characteristic had increased somewhat to about twice that of example 2, which was taken as standard (i.e. the characteristic had deteriorated) and, in the latter period of switching (during switching 19900~20000 times), had increased to 1.5~2.5 times (deterioration of characteristic). The rate of occurrence of restriking also showed a large increase (deterioration of characteristic) and variability. Specifically, when the frequency of occurrence of restriking of comparative example 8 was compared with the frequency of occurrence of restriking for 1000 times of interruption of example 2, which was taken as standard, it was found that, in the case of comparative example 8, there was an increase to 35~60 times (deterioration of characteristic) for 1000 times of interruption, while for 20000 times of interruption there was an increase (deterioration of characteristic) to 56~60 times. Regarding the erosion resistance (change in weight after interrupting 7.2 kV, 4.4 kA 1000 times), the erosion characteristic taking the erosion of example 2 as 1.0 had reached 10.6~21.8 times (comparative example 8).

According to the results of microscopic examination, the Cu portions of the surface of the contacts of comparative example 8 had selectively suffered severe irregularity damage. Therefore, this technique is effectively displayed if, in order to obtain a balance of restriking characteristic, current chopping characteristic and erosion resistance, in Cu—TiC—C alloy, the particle size of an auxiliary constituent selected from Co, Ni, Fe, or Cr is in the range below 10 μm, as shown in examples 16~19 and examples 1~15.

(Examples 20~23, Comparative Example 9)

In examples 1~19 and comparative examples 1~7 described above, the case was shown where the size of the C present in the Cu—TiC—C alloy in non-solid solution condition or condition in which does not form a chemical compound was 0.05 μm, but the benefits of the present invention are not restricted to the case where the mean particle (grain) size of the C is 0.05 μm. (The size of the C means its particle size; if the C is aggregated, this means the size of the aggregations. If the C is of irregular shape, it means the diameter when the irregular shape is converted to a circle).

Specifically, when the same evaluation as above was conducted with mean particle (grain) sizes of C of 0.01~5 μm, it was found that all of the chopping characteristic, rate of occurrence of restriking, and erosion resistance exhibited practically equivalent excellent characteristics (examples 20~23).

However, when the same evaluation was conducted for 50% TiC-5 Co balance Cu in which the mean particle (grain) size of C was 25 μm (comparative example 9), while the current chopping characteristic was at an allowed level, being in the range 0.9~1.8 times that of example 2, which was taken as standard, in the initial period of switching (during switching 1~100 times), in the latter period of switching (during switching 19900~20000 times) it had increased to 2.3~3.4 times (deterioration of characteristic). Also, the rate of occurrence of restriking showed a large increase (deterioration of characteristic) and variability. Specifically, taking the frequency of occurrence of restriking during interruption 1000 times in example 2, which was taken as standard, compared with the frequency of occurrence of restriking of comparative example 2, in comparative example 9 this had increased to 150~67.5 times for 1000 times of interruption (deterioration of characteristic) and, for 20000 times of interruption, had increased to 123~93 times. Regarding the erosion resistance (change of weight after switching 7.2 kV, 4.4 kA 1000 times), the erosion resistance taking the erosion of example 2 as standard at 1.0 had reached 10.6~21.8 times i.e. a considerable amount of erosion was shown (comparative example 9). It was found by microscopic examination that, in the case of comparative example 9, in which the mean particle (grain) size of the C was 25 μm, aggregations of C and depletion regions of C were present in the contact surface. From the above, it is effective for the mean particle (grain) size of the C, as shown in example s 20~23 to be 0.01~5 μm in order to obtain a balance of restriking characteristic, chopping characteristic and erosion resistance.

(Examples 24~25, Comparative Example 10)

Although example s 1~23 and comparative examples 1~9 show that benefits are displayed in alloys in which $TiC_{1.0}$ is employed as the stoichiometric ratio of Ti and C, the invention can be put into practice without restriction to TiC1.0. The same benefits are obtained by using as TiC $TiC_{0.95}$ and $TiC_{0.70}$ (examples 24~25). Specifically, when evaluation was conducted in the same way as described above, the chopping characteristic in the initial period of switching (during switching 1~100 times) was 1.2~1.1 times that of example 2, which was taken as standard, and, during the latter period of switching (19900~20000 times of switching) still only showed allowed change in the range of 1.3~1.2. Also regarding the restriking characteristic, taking the frequency of occurrence of restriking when interruption was performed 1000 times in example 2, which was taken as standard as reference, compared with the frequency of occurrence of restriking of comparative example 2, there was a change to 1.5~1.3 times for 1000 times of interruption and to 1.3~2.6 times for 20000 times of interruption. Regarding the erosion resistance also (change in weight after switching 7.2 kV, 4.4 kA 1000 times), the erosion characteristic taking the erosion of example 2 which was taken as standard as 1.0 was practically unchanged, showing an erosion amount of 1.05~1.1 times. As shown above, excellent, practically equivalent characteristics are exhibited in both cases (example s 24~25). In contrast, when TiC of stoichiometric ratio $TiC_{0.55}$ of Ti and C was employed (comparative example 10), the current chopping characteristic in the initial switching period (number of times of switching 1~100) was increased to 1.4 times that of example 2, which was used as the standard, and in the latter period of switching (19900~20000 times of switching) was increased to a range of 1.8~3.3 times. Also regarding the restriking characteristic, using the frequency of occurrence of restriking at 1000 times of interruption of example 2, which was taken as the standard, as reference, in comparison with the frequency of occurrence of restriking in comparative example 2, in comparative example 10, this was increased by 13~7.2 times at 1000 times of switching and was increased to 9.3~12.3 times at 20000 times of switching. Also, the erosion resistance (change in weight after interrupting 7.2 kV, 4.4 kA 1000 times) was increased by 18.4~24.8 times, compared with the erosion of reference example 2 which was taken as 1.0 and used as a standard value; thus, the amount of erosion showed a considerable increase (comparative example 10).

(Example 26, Reference Example 11).

It has been shown that, in the Cu—TiC—C contact material of these examples, TiC content, the stoichiometric relationship of Ti and C, and the size of the TiC (mean particle (grain) size) is important in maintaining the current chopping characteristic, restriking characteristic and erosion resistance. In addition, it was found that the size of the C (i.e. the particle size of the C; if the C is aggregated, then the size of these aggregations. If the C is of irregular shape, this indicates the diameter when such irregular shape is converted to a circle) that is present in non-solid solution condition or condition in which it does not form a chemical compound in the Cu—TiC—C alloy is also extremely important in obtaining a balance of these characteristics in a preferred range.

However, according to the present invention, it is possible to further improve the benefits and reliability not just by means of the mode in which TiC is present as described above (i.e. the TiC content, the stoichiometric ratio of Ti and C, and the size of the TiC) and the mode of presence of the C (C content and C size), but also by controlling the degree of dispersion of the C in the alloy (separation between the most closely adjacent C particles) in a desired range.

Specifically, regarding the dispersion of the C, there exists the case where the separation L between the two most closely adjacent C particles is such that they are separated by more than the diameter d of the smallest C grain of the two C particles i.e. $L>d$ (this is symbolized by X), and there exists the case where the separation L of the two most closely adjacent C particles is such that they are separated by an amount equal to or more than the diameter d of the smallest of the two C particles i.e. $L \geqq d$ (symbolized by Y). In examples 1~25 and comparative examples 1~10, X or X~Y is indicated. However, in this example of the present invention, an excellent characteristic is shown even in the range of Y (example 26).

However, in contrast, regarding the C dispersion, in the case where the separation L between the two most closely adjacent C particles is such that L≦d i.e. L approaches or is less than the diameter d of the smallest C particle of the two C particles (symbolized by Z), a marked deterioration of characteristic is shown and this degree of dispersion of C is therefore undesirable (comparative example 11).

(Example 27, Comparative Example 12)

In the case of examples 1~26 and comparative examples 1~11 described above, the benefits were indicated for the case where all the sample contacts were of fixed thickness of 3 mm. However, benefits are displayed even when the thickness of the contacts is not restricted to 3 mm. Specifically, excellent characteristics are displayed with contacts of thickness 0.3 mm (example 27). However, when the thickness of the alloy layer was made 0.05 mm (comparative example 12), exposure of the pure Cu layer which is the underlayer of part of the contact surface, and/or cracking or fracture of the alloy layer after evaluation of interrupter characteristics were observed. In addition, the contacts became separated from the base during the process of switching or interruption, so evaluation of the restriking characteristic and erosion resistance was discontinued. It is therefore desirable that the thickness of the alloy layer should be at least not less than 0.3 mm.

It is possible to improve the conductivity of the contact blanks by increasing the Cu content towards the interior of the Cu—TiC contacts (perpendicular direction), or by adding a Cu layer below this alloy layer.

(Examples 28~29, Comparative Example 13)

In example s 1~27 and comparative examples 1~12 described above, the benefits were indicated for the case where the mean surface roughness after finishing of the contact surfaces was fixed at 0.3 μm. However, the benefits are not restricted to the case where the mean surface roughness is 0.3 μm. Specifically, desirable characteristics are exhibited (examples 28~29) even when the mean surface roughness after finishing of the contact surfaces is 0.05 μm or 10 μm. However, on the other hand, making the mean surface roughness of the contact surface extremely smooth was excluded from the present invention on account of the problems of cost.

In contrast, when the mean surface roughness after finishing of the contact surface was 36 μm (comparative example 13), the chopping characteristic in the initial period of switching (during switching 1~100 times) was 1.2~1.1 times that of example 2, which was taken as standard and, even during the latter period of switching (during switching 19900~20000 times) was 1.0 times i.e. an extremely stable and desirable characteristic was displayed. However, the restriking characteristic showed a severe increase in the frequency of restriking and also a large variability. Specifically, taking as reference the frequency of occurrence of restriking on interruption 1000 times of example 2 which was taken as standard, comparing with the frequency of restriking of comparative example 13, in comparative example 13, restriking was increased by 32~23.5 times for 1000 times of interruption (lowering of characteristic), while, for 20000 times of interruption, it was increased to 35~34 times (i.e. a lowering of characteristic). The amount of erosion resistance was also increased by 6.2~20.6 times.

It is therefore desirable that the mean surface roughness after finishing of the contact surface should be 0.05~10 μm.

It should be noted that, in regard to contact faces whose mean surface roughness was finished to 0.05~10 μm as described above, a further contribution to stability of the restriking characteristic can be obtained by applying additional finishing to the contact surface by interrupting a small current of 1~10 mA in the condition with a voltage of 20 kV applied.

Also, the present invention may be modified as follows.

(Modified Example-1)

Although in the above examples 1~29 and comparative examples 1~13, cases were illustrated in which TiC was employed as the anti-arcing constituent, completely equivalent characteristics and benefits can be obtained by substituting VC (vanadium carbide) for some or all of the TiC. Specifically, the TiC of the Cu-50 volume % Ti-0.05 weight % C alloy (with 0.9 weight % Co as auxiliary constituent) shown in example 2 can be replaced by VC (example 30). When half of the TiC was substituted by VC (example 31), and the same evaluation was conducted, it was found that for both of these, the current chopping characteristic was within the allowed range, showing a stable and desirable current chopping characteristic and low range of fluctuation, the chopping characteristic in the initial period of switching (during switching 1~100 times) being in the range 0.9~1.1 times, and the chopping characteristic in the latter period of switching (during switching 19900~20000 times) being in the range 1.0~1.2 times. Also the rate of occurrence of restriking was within a preferred range of 1.2~1.3. In particular, even comparing the cases of a number of times of interruption of 1000 times and 20000 times respectively, no marked difference between these two was found and there was little variability. The erosion resistance also showed a practically equivalent characteristic, being in the range 1.1~1.3 times.

(Modified Example-2)

In example s 1~29, comparative examples 1~13 and modified example 1, evaluation results of chopping characteristic, restriking characteristic and erosion resistance were indicated, chiefly for Cu—TiC—C alloy. However, in the case of vacuum interrupters in which particularly high resistance to welding is demanded, addition of an anti-welding constituent in the amount of 0.05~0.5 weight % to the main alloy is beneficial. Specifically, a test was conducted under the same conditions as given previously on alloy (example 32) obtained by adding for example 0.2 weight % of Bi to the Cu-50 volume % TiC-0.05 weight % C alloy (with 0.9 weight % of Co as auxiliary constituent) indicated in example 2, the current chopping characteristic in the initial period of switching (during switching 1~100 times) was 0.8~1.1 times and in the latter period of switching was in the range 1.0~1.3 times; thus a stable, desirable current chopping characteristic and low range of fluctuation were displayed, which were within the allowed range. Also the rate of occurrence of restriking was in the preferred range of 0.9~ 1.0. In particular, even comparing the case of 1000 times of interruption and the case of 20000 times of interruption, no marked difference was observed between these two, and furthermore there was little variability. The erosion resistance also showed a practically equivalent characteristic, being in the range 1.1~1.2 times.

As described above, according to the present invention, thanks to the provision of: an anti-arcing constituent consisting of at least one of TiC, V and VC of which the content is 30~70 volume % and which has a mean particle (grain) size of 0.1–9 μm; C whose content is 0.005~0.5 weight % with respect to the anti-arcing constituent, which has a diameter of 0.01~5 μm when the shape is calculated as a sphere, and which is in a non-solid solution condition or condition in which it does not form a chemical compound; and a conductive constituent constituting the balance and consisting of Cu, a contact material can be obtained which combines both a good current chopping characteristic and a good voltage withstanding characteristic.

Obviously, numerous additional modifications and variations of the present invention are possible in the light of the above teachings. It is therefore to be understood that within the scope of the appended claims, the present invention may be practiced otherwise than as specially described herein.

What is claimed as new and desired to be secured by Letters Patent of the United States is:

1. A contact material, comprising:

an anti-arcing constituent consisting of at least one of TiC, V and VC whose mean particle (grain) size is 0.1~9 μm and of which the content is 30~70 volume %;

C(carbon), in a content of 0.005~0.5 weight % with respect to said anti-arcing constituent, its diameter being 0.01~5 μm when its shape is calculated as spherical and being in a non-solid solution condition or condition in which does not form a chemical compound; and a conductive constituent constituting the balance and consisting of Cu.

2. A contact material according to claim 1, wherein: said contact material contains an auxiliary constituent comprising (a) at least one of Co, Ni and Fe in a content of less than 5 weight % with respect to said anti-arcing constituent and of mean particle (grain) size under 10 μm; or (b) Cr in a content of less than 2 weight % with respect to said anti-arcing constituent and whose mean particle (grain) size is under 10 μm.

3. A contact material according to claim 1 or claim 2, wherein:

said C (carbon) is dispersed and distributed in an alloy of said conductive constituent and anti-arcing constituent, said separation between particles of said C being greater than the size of C particles which are most closely adjacent.

4. A contact material according to claim 1, wherein:

said contact material contains 0.05~0.5 weight % of at least one of Bi, Sb and Te.

5. A contact material according to claim 1 or claim 2, wherein:

said anti-arcing constituent is TiC and the stoichiometric ratio Ti:C of said TiC is 1:1~1:0.7.

6. A contact material according to claim 1, wherein:

thickness of said contact material is not less than 0.3 mm.

7. A contact material according to claim 1, wherein:

mean surface roughness Rave of said contact material is 0.05~10 μm.

8. A contact material according to claim 1, wherein:

the Cu content of said contact material has a graded distribution such that it increases from the contact surface towards the non-contact surface on the other side or wherein a Cu layer is attached to said non-contact surface.

* * * * *